US011197560B2

(12) United States Patent
Taylor et al.

(10) Patent No.: US 11,197,560 B2
(45) Date of Patent: Dec. 14, 2021

(54) FOLDABLE BASSINET

(71) Applicant: Wonderland Switzerland AG, Steinhausen (CH)

(72) Inventors: Andrew J. Taylor, Mohnton, PA (US); Daniel A. Sack, Pottstown, PA (US); Patrick J. G. Bowers, Hockessin, DE (US); Curtis M. Hartenstine, Birdsboro, PA (US); Peter R. Tuckey, Leola, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 138 days.

(21) Appl. No.: 16/403,605

(22) Filed: May 5, 2019

(65) Prior Publication Data

US 2019/0335917 A1 Nov. 7, 2019

Related U.S. Application Data

(60) Provisional application No. 62/667,863, filed on May 7, 2018, provisional application No. 62/730,165, filed on Sep. 12, 2018.

(51) Int. Cl.

| | |
|---|---|
| ***A47D 9/00*** | (2006.01) |
| ***A47D 13/02*** | (2006.01) |
| ***A47D 13/06*** | (2006.01) |

(52) U.S. Cl.

CPC ..... *A47D 9/005* (2013.01); *A47D 13/02* (2013.01); *A47D 13/06* (2013.01)

(58) Field of Classification Search

CPC ..... A47D 9/005; A47D 13/02; A47D 13/06; A47D 13/061; A47D 13/066; A47D 9/00; (Continued)

(56) References Cited

U.S. PATENT DOCUMENTS 3,632,007 A * 1/1972 Kantor ..... E05C 1/10 217/57
4,371,206 A 2/1983 Johnson, Jr.
(Continued)

FOREIGN PATENT DOCUMENTS

CN 102727002 A 10/2012
CN 206552092 U 10/2017
(Continued)

*Primary Examiner* — Nicholas F Polito
*Assistant Examiner* — George Sun
(74) *Attorney, Agent, or Firm* — Volpe Koenig

(57) ABSTRACT

A foldable bassinet includes an upper bassinet frame, a pair of leg structures opposite to each other, and a bottom board. Each leg structure has an upper tower portion and a lower ledge portion. The upper bassinet frame is disposed through the upper tower portion of each leg structure to make each leg structure pivotable relative to the upper bassinet frame between a supporting position and a folding position. The bottom board is detachably configured between the two lower ledge portions and defines a containing space cooperatively with the upper bassinet frame and the leg structures. When the bottom board is detached from the two lower ledge portions, the leg structures are rotatable from the supporting position to the folding position to be folded inwardly relative to the upper bassinet frame.

12 Claims, 11 Drawing Sheets

(58) Field of Classification Search
CPC ..... A47D 15/003; A47C 17/84; E05C 1/10; Y10T 292/1022; Y10T 292/0997
See application file for complete search history.

(56) References Cited

U.S. PATENT DOCUMENTS

| | | | | |
|---|---|---|---|---|
| 5,028,061 | A | 7/1991 | Hawkes | |
| 5,146,632 | A * | 9/1992 | Li | A47D 7/02 292/175 |
| 5,299,818 | A | 4/1994 | Newbold | |
| 5,956,786 | A * | 9/1999 | Huang | A47D 9/02 5/105 |
| 6,736,451 | B1 | 5/2004 | Chen | |
| 7,377,537 | B2 | 5/2008 | Li | |
| 9,534,628 | B1 | 1/2017 | Wang | |
| 2004/0031097 | A1 | 2/2004 | Kane | |
| 2006/0185082 | A1 * | 8/2006 | Casati Troutman | A47D 13/066 5/99.1 |
| 2010/0162484 | A1 * | 7/2010 | Thomas | A47D 13/063 5/93.2 |
| 2012/0036634 | A1 * | 2/2012 | Pacella | A47D 13/06 5/93.1 |
| 2012/0058834 | A1 | 3/2012 | Zhang | |
| 2012/0235103 | A1 * | 9/2012 | Greger | A47D 9/005 256/25 |
| 2014/0070590 | A1 | 3/2014 | Zhong | |
| 2014/0191173 | A1 * | 7/2014 | Saint | A47D 13/061 256/25 |
| 2014/0273719 | A1 * | 9/2014 | Weisman | A63H 33/006 446/227 |
| 2015/0007387 | A1 * | 1/2015 | Lo | A47D 13/063 5/98.1 |
| 2015/0015036 | A1 | 1/2015 | Soriano | |
| 2015/0059088 | A1 * | 3/2015 | Szymanski | F16C 11/04 5/99.1 |
| 2015/0216322 | A1 * | 8/2015 | Longenecker | A47D 9/005 5/99.1 |
| 2015/0342368 | A1 | 12/2015 | Corso | |
| 2016/0198864 | A1 * | 7/2016 | Yang | A47D 15/00 5/655 |
| 2017/0172311 | A1 * | 6/2017 | Longenecker | F16B 7/00 |
| 2017/0196373 | A1 * | 7/2017 | Sclare | A47D 13/06 |
| 2017/0238721 | A1 * | 8/2017 | Damiani | A47D 7/02 |
| 2017/0290444 | A1 * | 10/2017 | Mao | A47D 13/06 |
| 2017/0328080 | A1 * | 11/2017 | Larimore | E05D 15/063 |
| 2018/0008056 | A1 * | 1/2018 | Yang | A47D 7/002 |
| 2018/0014658 | A1 | 1/2018 | Horst | |
| 2018/0070738 | A1 | 3/2018 | Burns | |
| 2018/0098641 | A1 | 4/2018 | Kapanzhi | |
| 2018/0110344 | A1 * | 4/2018 | Matsumoto | A47D 13/06 |
| 2018/0192786 | A1 * | 7/2018 | Horst | A47D 7/005 |
| 2018/0206652 | A1 * | 7/2018 | Gallina | A47D 9/04 |

FOREIGN PATENT DOCUMENTS

| | | | |
|---|---|---|---|
| EP | 2 671 472 | A1 | 12/2013 |
| EP | 2 710 930 | A2 | 3/2014 |
| GB | 2 451 760 | A | 2/2009 |
| GB | 2554502 | A | 4/2018 |
| GN | 107374169 | A | 11/2017 |
| KR | 10-2016-0068208 | A | 6/2016 |

* cited by examiner

FOLDABLE BASSINET

CROSS REFERENCE TO RELATED APPLICATIONS

This application claims the benefit of U.S. Provisional Application No. 62/667,863, which was filed on May 7, 2018, and the benefit of U.S. Provisional Application No. 62/730,165, which was filed on Sep. 12, 2018, and is incorporated herein by reference.

BACKGROUND OF THE INVENTION

1. Field of the Invention

The present invention relates to a bassinet, and more specifically, to a foldable bassinet.

2. Description of the Prior Art

A typical bassinet is often large and difficult to store. Consequently, the portability of the bassinet is also inhibited. In practical application, a bassinet further designed to integrate with a playard is usually incapable of remaining usable when removed from the playard.

Furthermore, the bassinet having dual functionality for use on and off the playard can have a complex mechanical design, causing much inconvenience to a caregiver in operating the bassinet. Additionally, the aforesaid dual functionality design can pose greater risk of a young child accidentally adjusting the configuration of the bassinet, causing a threat to the infant lying in the bassinet.

SUMMARY OF THE INVENTION

The present invention provides a foldable bassinet. The foldable bassinet includes an upper bassinet frame, a pair of leg structures opposite to each other, and a bottom board. Each leg structure has an upper tower portion and a lower ledge portion. The upper bassinet frame is disposed through the upper tower portion of each leg structure to make each leg structure pivotable relative to the upper bassinet frame between a supporting position and a folding position. The bottom board is detachably configured between the two lower ledge portions and defines a containing space cooperatively with the upper bassinet frame and the leg structures. When the bottom board is detached from the two lower ledge portions, the leg structures are rotatable from the supporting position to the folding position to be folded inwardly relative to the upper bassinet frame.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
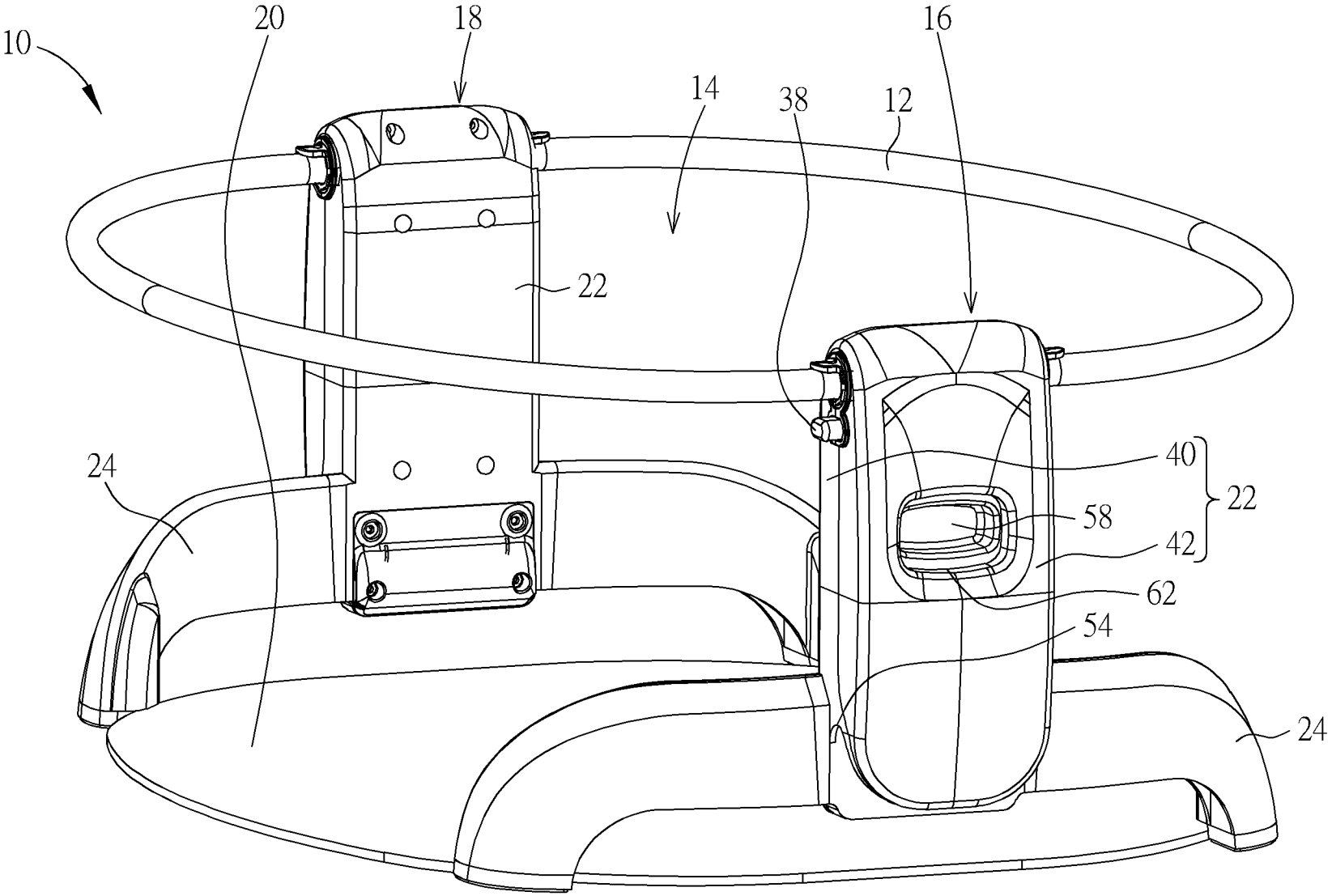
FIG. 1 is a diagram of a foldable bassinet according to an embodiment of the present invention.
Figure 2:
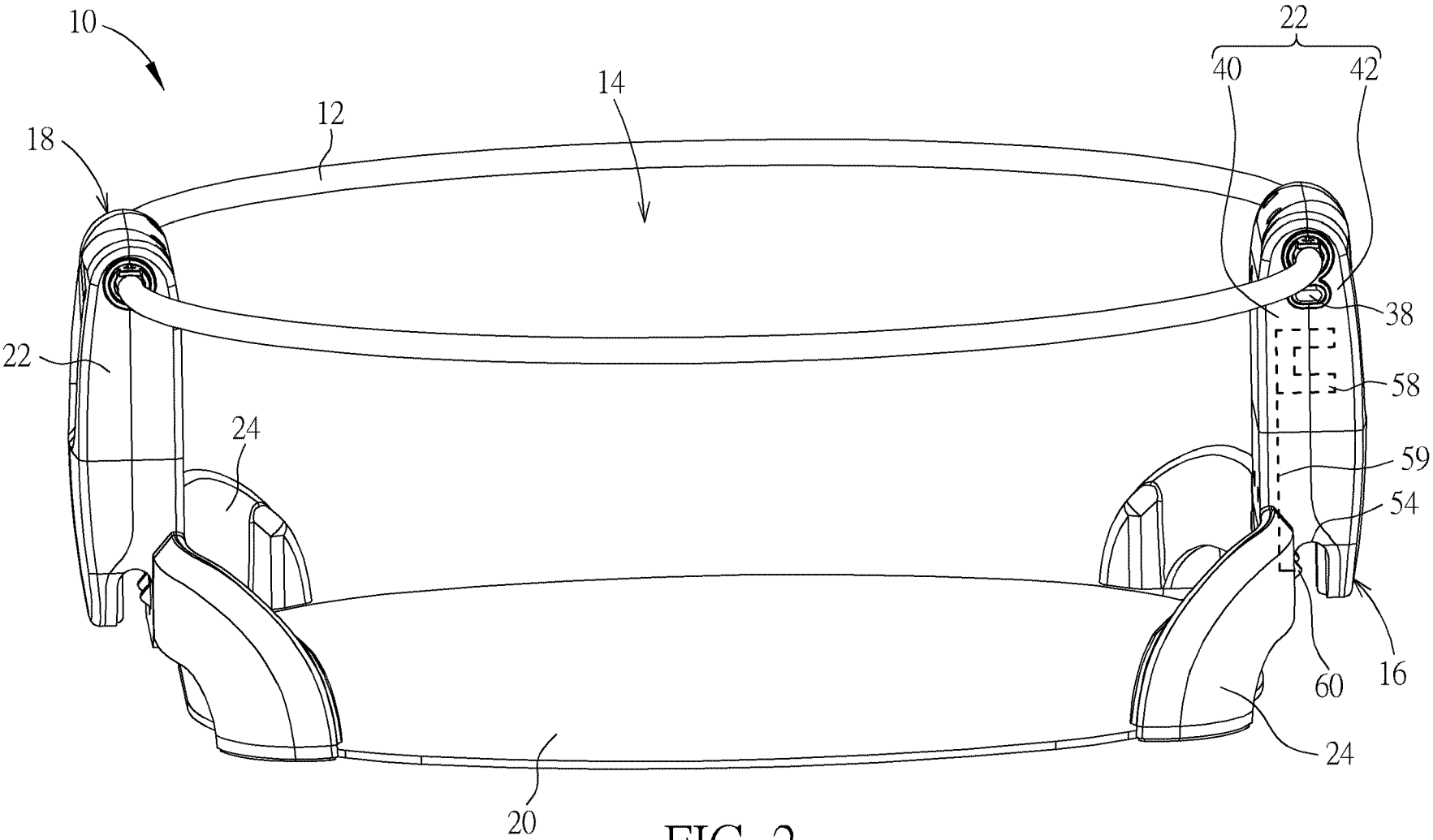
FIG. 2 is a diagram of the foldable bassinet in FIG. 1 from another viewing angle.

Please refer to FIG. 1 and FIG. 2. FIG. 1 is a diagram of a foldable bassinet 10 according to an embodiment of the present invention. FIG. 2 is a diagram of the foldable bassinet 10 in FIG. 1 from another viewing angle. As shown in FIG. 1 and FIG. 2, the foldable bassinet 10 includes an upper bassinet frame 12, a pair of leg structures 16, 18 opposite to each other, and a bottom board 20. The upper bassinet frame 12 has a generally oval shape and is attached to a bassinet fabric to create a welcoming area for an infant. Each of the leg structures 16, 18 is preferably made of injection molded plastic material (but not limited thereto) and has an upper tower portion 22 and a lower ledge portion 24. The upper bassinet frame 12 is disposed through the upper tower portions 22 of the leg structures 16, 18 to make the leg structures 16, 18 pivotable relative to the upper bassinet frame 12 between a supporting position for use and a folding position for storage or transport. The bottom board 20 is detachably configured between the two lower ledge portions 24 and defines a containing space 14 cooperatively with the upper bassinet frame 12 and the leg structures 16, 18 for allowing a caregiver to place an infant thereon. To be noted, because the leg structures 16, 18 are foldable inwardly relative to the upper bassinet frame 12, the bottom board 20 can also prevent folding of the foldable bassinet 10 when the bottom board 20 is captured between the two lower ledge portions 24.

Figure 3:
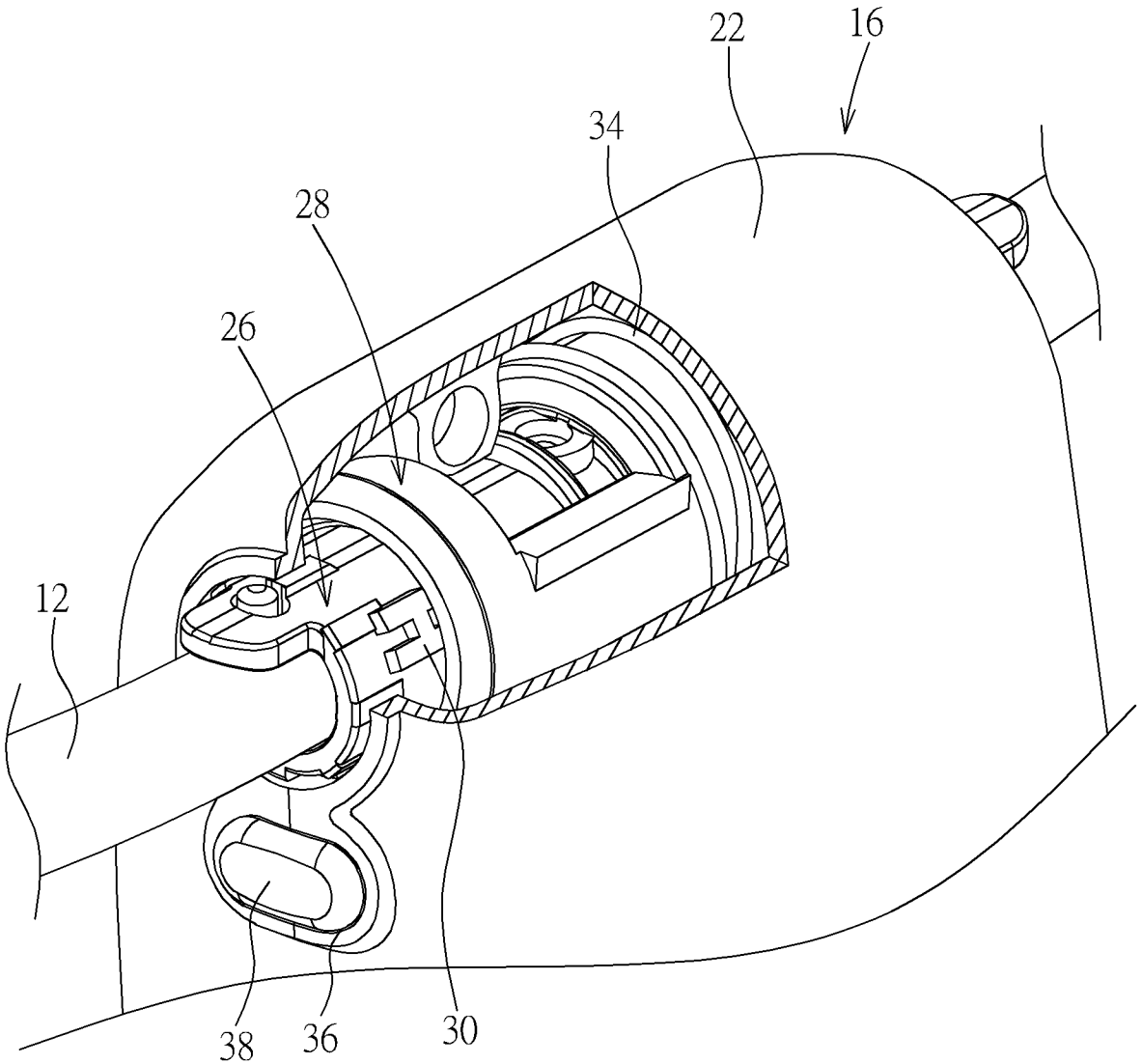
FIG. 3 is a partial internal diagram of a leg structure in FIG. 2.
Figure 4:
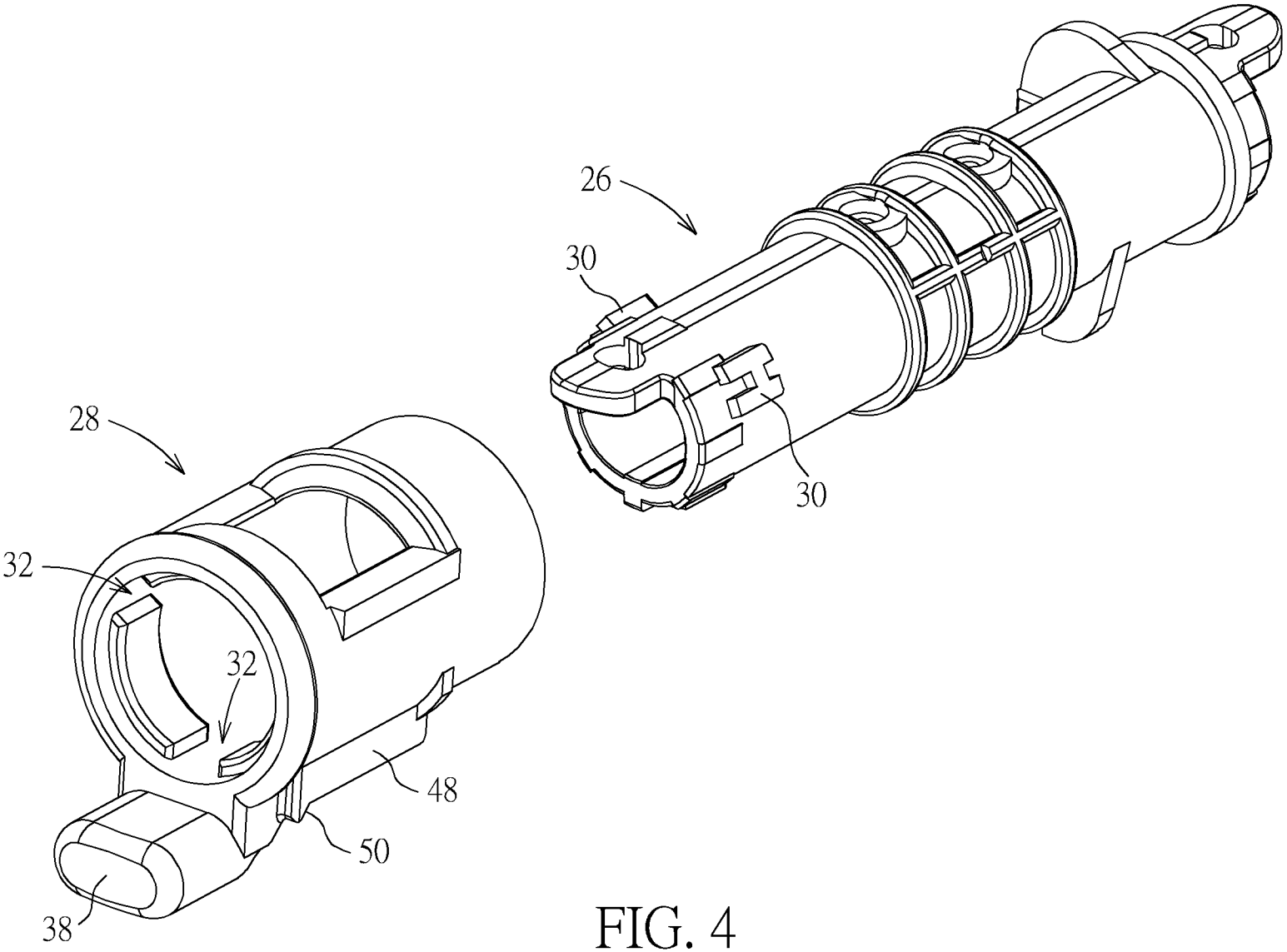
FIG. 4 is an exploded diagram of a bushing and a locking hub in FIG. 3.
Figure 5:
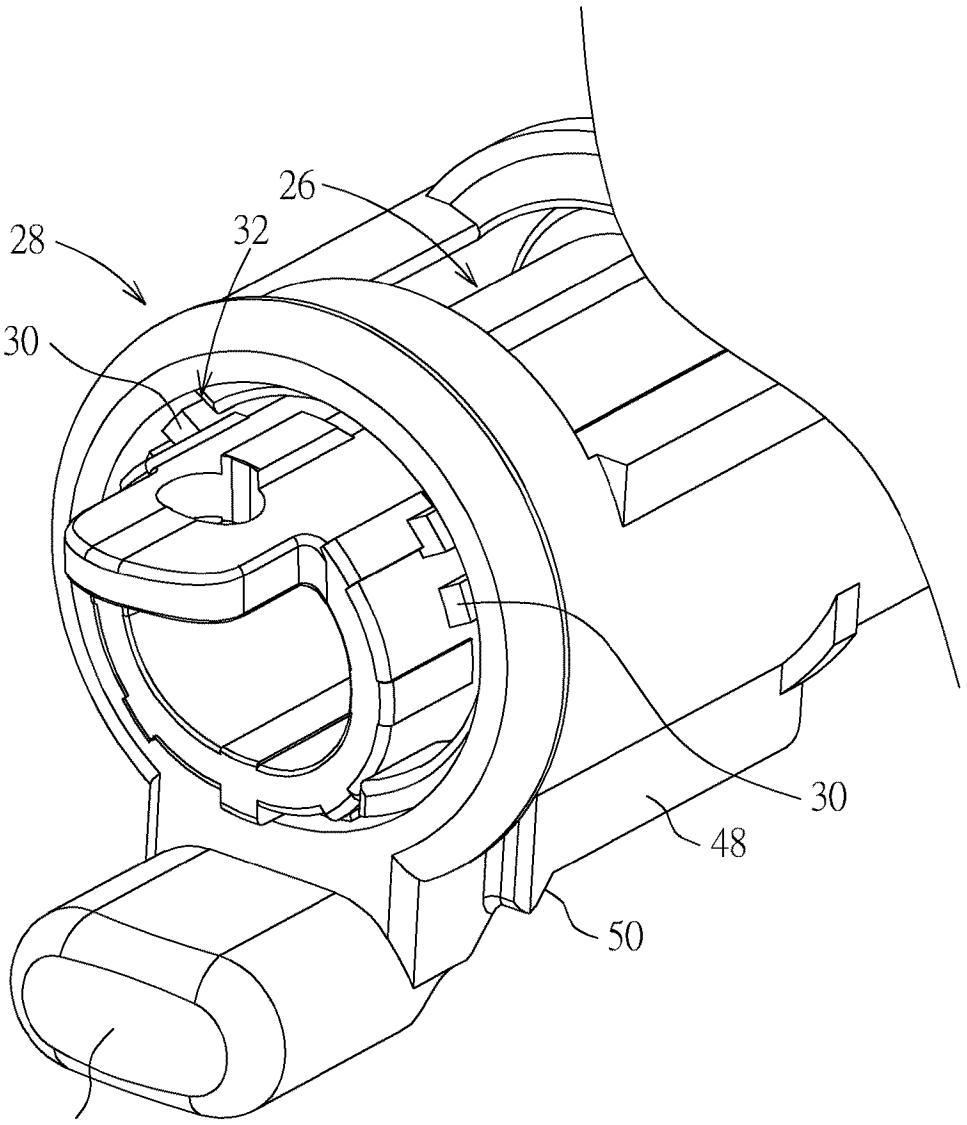
FIG. 5 is an enlarged diagram of the locking hub being locked on the bushing in FIG. 3.

In this embodiment, a locking mechanical design is applied to the leg structure 16 for locking the leg structure 16 at the supporting position or the folding position, but not limited thereto, meaning that the locking mechanical design can be also applied to the leg structure 18 and the related description could be reasoned by analogy according to this embodiment and omitted herein. Please refer to FIG. 2, FIG. 3, FIG. 4 and FIG. 5. FIG. 3 is a partial internal diagram of the leg structure 16 in FIG. 2. FIG. 4 is an exploded diagram of a bushing 26 and a locking hub 28 in FIG. 3. FIG. 5 is an enlarged diagram of the locking hub 28 being locked on the bushing 26 in FIG. 3.

As shown in FIGS. 2-5, the foldable bassinet 10 could further include the bushing 26 and the locking hub 28. The bushing 26 is secured to the upper bassinet frame 12 within the upper tower portion 22 to rotate together with the upper bassinet frame 12, and has at least one protrusion 30 formed thereon (preferably three radially arranged on the bushing 26, but one not shown in FIG. 4 due to the viewing angle). The locking hub 28 is concentrically located and transversely movable (preferably slidable, but not limited thereto) on the bushing 26 to be transversely movable within the upper tower portion 22 and includes an engagement channel 32 formed therein for engaging with the protrusion 30. Accordingly, when the locking hub 28 moves to a locked position as shown in FIG. 5, the protrusion 30 is engaged with the engagement channel 32 for stopping rotation of the leg structure 16 relative to the upper bassinet frame 12, such that the foldable bassinet 10 can be in an expanded state as shown in FIG. 1 steadily for use. On the other hand, when the locking hub 28 moves to an unlocked position as shown in FIG. 3, the protrusion 30 is disengaged from the engagement channel 32 to make the leg structure 16 rotatable relative to the upper bassinet frame 12. Furthermore, as shown in FIG. 3, the foldable bassinet 10 could further include a spring 34 configured between the locking hub 28 and the upper tower portion 22 for biasing the locking hub 28 to the locked position, so as to make locking between the leg structure 16 and the upper bassinet frame 12 more firm for safety.

Furthermore, as shown in FIGS. 3-5, a button hole 36 is formed on the upper tower portion 22, and the locking hub 28 further includes a release button 38 corresponding to the button hole 36. Accordingly, when the locking hub 28 is located at the locked position, the release button 38 passes through the button hole 36 to be touchable on the upper tower portion 22 (as shown in FIG. 1) for the caregiver to press. On the other hand, when the release button 38 is pressed to override the biasing force of the spring 34 as shown in FIG. 3, the locking hub 28 moves to the unlocked position.

Figure 6:
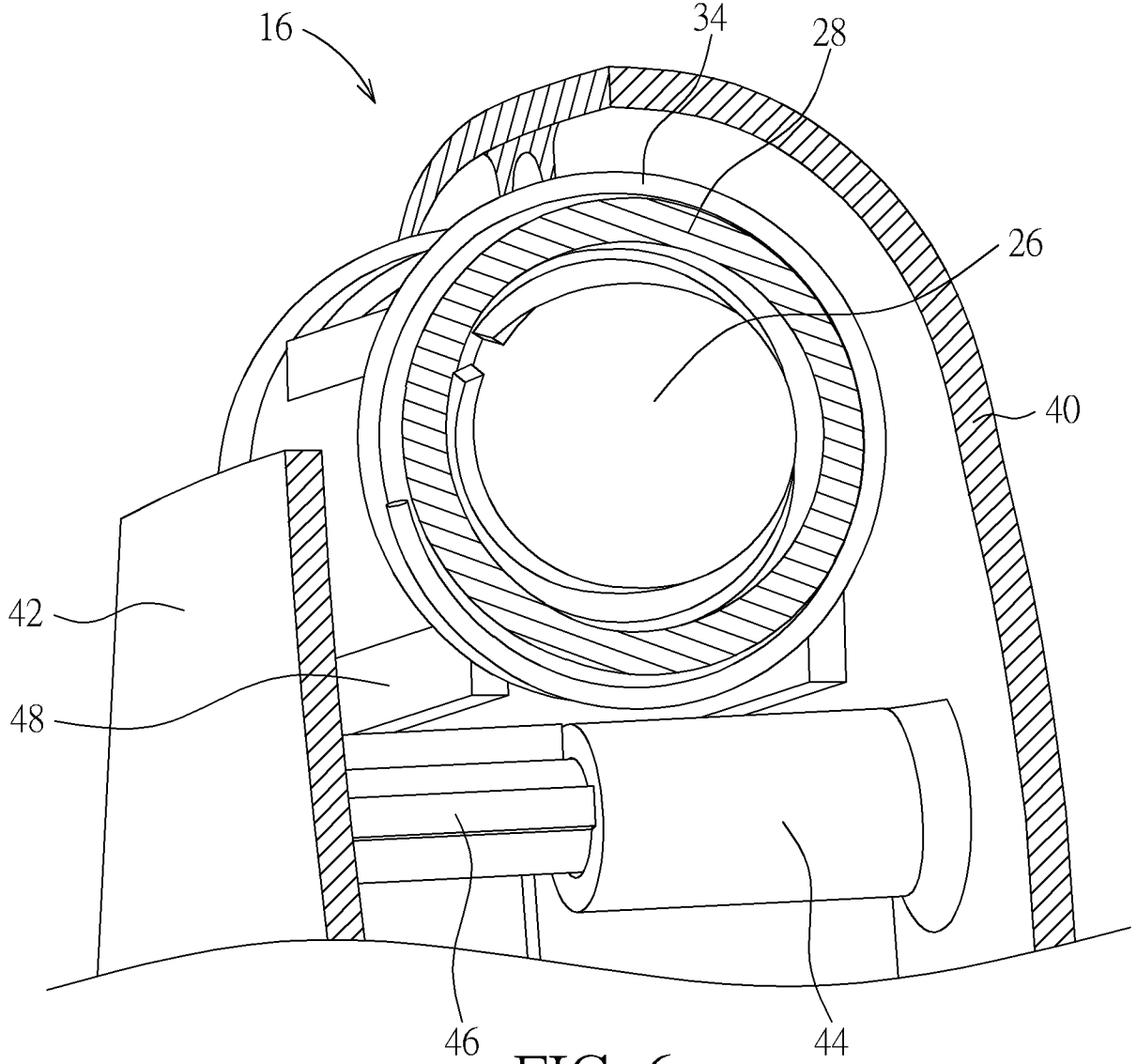
FIG. 6 is a partial cross-sectional diagram of the leg structure in FIG. 3.

Moreover, in this embodiment, the upper tower portion 22 includes a supporting body 40 and a cover 42, and the lower ledge portion 24 extends downward from the supporting body 40 (as shown in FIG. 2). To be more specific, please refer to FIG. 6, which is a partial cross-sectional diagram of the leg structure 16 in FIG. 3. As shown in FIG. 6, the supporting body 40 has a bearing 44 formed under the locking hub 28, and the cover 42 has a riveting pin 46 corresponding to the bearing 44. As such, the riveting pin 46 can be inserted into the bearing 44 to lock the cover 42 on the supporting body 40 for containing the locking hub 28 and the bushing 26. In addition, for preventing the caregiver from over-pushing the locking hub 28, as shown in FIG. 4 and FIG. 6, a rib 48 extends downward from the locking hub 28 and has an inclined-surface structure 50. In such a manner, when the locking hub 28 moves to the unlocked position, the bearing 44 abuts against the inclined-surface structure 50 to stop the locking hub 28 from moving over the unlocked position, so as to remind the caregiver that the locking hub 28 has been pushed to the unlocked position.

Figure 7:
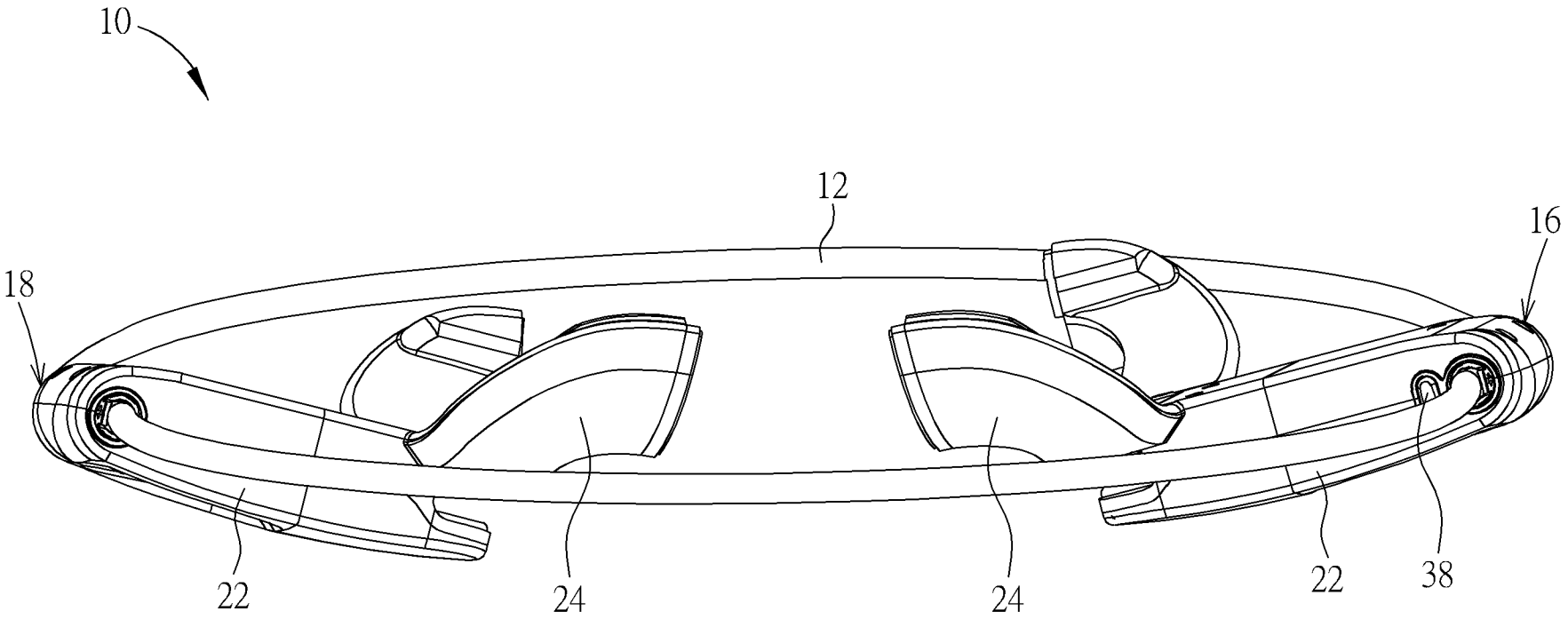
FIG. 7 is a diagram of the foldable bassinet in FIG. 2 being folded when a bottom board is detached from two lower ledge portions.

Via the aforesaid designs, the foldable bassinet 10 allows that the caregiver can fold the foldable bassinet 10 for convenient storage or transport. For example, please refer to FIGS. 1-5 and 7. FIG. 7 is a diagram of the foldable bassinet 10 in FIG. 2 being folded when the bottom board 20 is detached from the two lower ledge portions 24. As shown in FIGS. 1-5 and 7, when the caregiver wants to fold the foldable bassinet 10, the caregiver just needs to first raise the bottom board 20 above the upper bassinet frame 12 and then press the release button 38. During the aforesaid process, the locking hub 28 moves from the locked position as shown in FIG. 5 to the unlocked position as shown in FIG. 3 to disengage the protrusion 30 form the engaging channel 32. Accordingly, since engagement between the locking hub 28 and the bushing 26 is released to make the leg structure 16 rotatable relative to the upper bassinet frame 12, the caregiver can rotate the leg structure 16 and the leg structure 18 from the supporting position as shown in FIG. 2 to the folding position as shown in FIG. 7. In such a manner, the two leg structures 16, 18 can be folded inwardly relative to the upper bassinet frame 12 for convenient storage or ease of transport. In summary, the present invention can efficiently solve the prior art problem that a typical bassinet is often large and difficult to store, so as to greatly improve the portability of the foldable bassinet.

Figure 8:
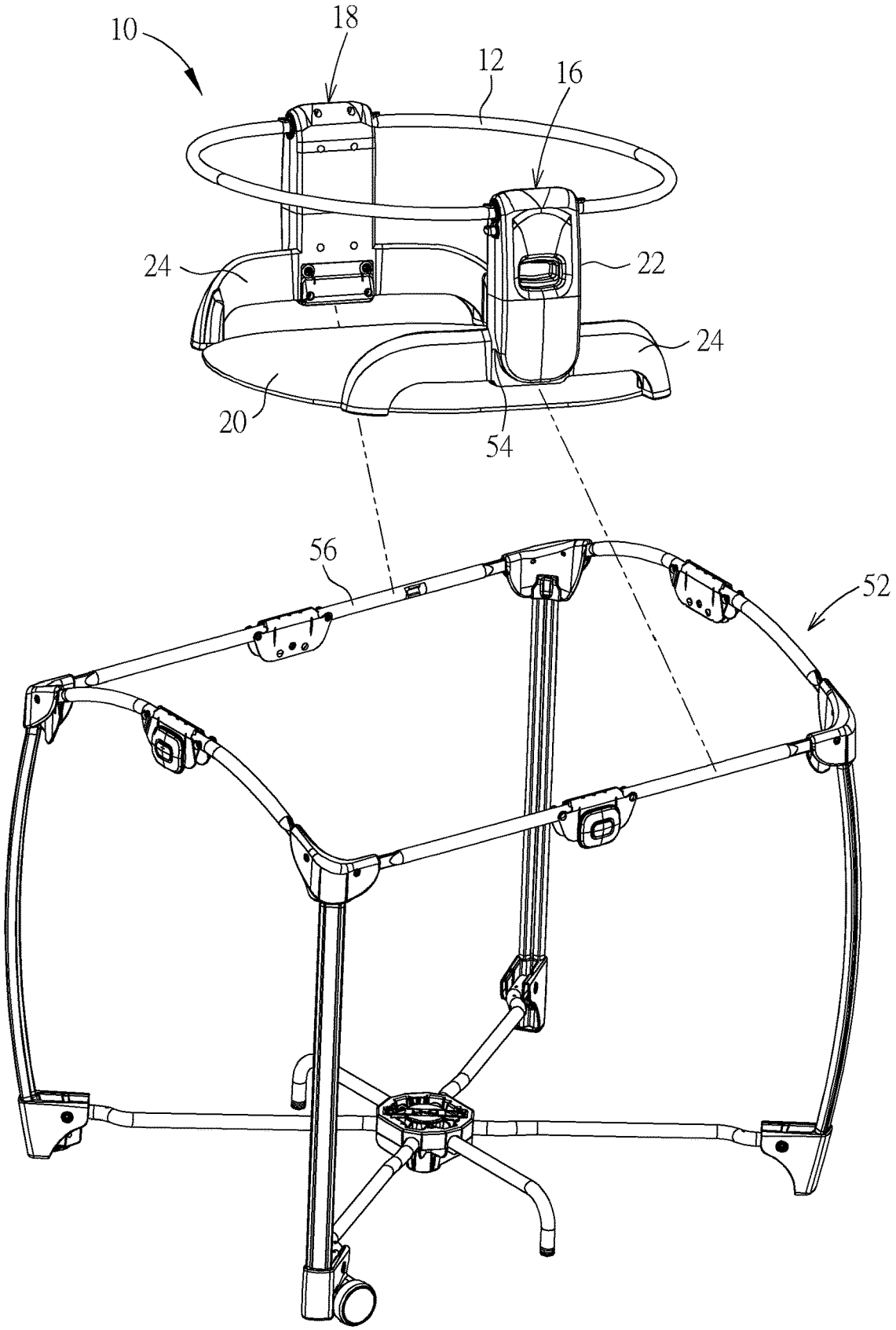
FIG. 8 is an exploded diagram of the foldable bassinet in FIG. 1 and a playard.

The foldable bassinet 10 can be further applied to mounting on a playard. For example, please refer to FIG. 8, which is an exploded diagram of the foldable bassinet 10 in FIG. 1 and a playard 52 (briefly depicted in FIG. 8). As shown in FIG. 8, a receiving area 54 is formed on a bottom of the upper tower portion 22 of the leg structure 16 for detachably engaging with a top rail 56 of the playard 52, such that the foldable bassinet 10 can be mounted on the playard 52 for infant care.

In practical application, as shown in FIG. 1 and FIG. 2, the foldable bassinet 10 could further include a latch release 58 (briefly depicted by dotted lines in FIG. 2) and an engagement latch 60. The latch release 58 is slidably disposed within the upper tower portion 22. The engagement latch 60 is linked to the latch release 58 (preferably via a link 59 (briefly depicted by dotted lines in FIG. 2), but not limited thereto) and retractably disposed on the upper tower portion 22 corresponding to the receiving area 54 for engaging with the top rail 56, such that the leg structure 16 can be locked on the playard 52 more firmly.

On the other hand, when the latch release 58 is operated to retract the engagement latch 60, engagement between the engagement latch 60 and the top rail 56 is released to make the leg structure 16 detachable from the playard 52. As for the related description for the latch and release designs of the latch release 58 and the engagement latch 60, it is commonly seen in the prior art and omitted herein. To be noted, for operational safety, a carrying handle cavity 62 is formed on the upper tower portion 22 corresponding to the latch release 58 for exposing the latch release 58. Accordingly, the latch release 58 is conveniently accessed when the caregiver's hand is engaged in the carrying handle cavity 62, and this provides a secure, convenient, and ergonomic means for the caregiver to grasp the foldable bassinet 10 on both sides, unlatch engagement between the engagement latch 60 and the top rail 56 and lift the foldable bassinet 10 off the playard 52 for independent use of the foldable bassinet 10.

In addition, the aforesaid design can ensure that a young child on the exterior of the foldable bassinet 10 would have a difficult time sufficiently engaging his palm into the carrying handle cavity 62 and applying an upward force on the latch release 58, so as to prevent the young child from inadvertently disengaging the foldable bassinet 10 from the playard 52. Conversely, the carrying handle cavity 62 is sized to necessitate finger activation of the latch release 58 by finger force. Thus, the present invention exhibits a convenient method of removing the foldable bassinet 10 from the playard 52 while protecting against accidental adjustment of configuration of the foldable bassinet 10.

In summary, via the aforesaid simple latch design, the present invention can solve the prior art problem that a bassinet having dual functionality for use on and off a playard has a complex mechanical design and the aforesaid dual functionality design poses greater risk of a young child accidentally adjusting the configuration of the bassinet, so as to greatly enhance operational convenience and safety of the foldable bassinet.

It should be mentioned that the locking design for stopping rotation of the leg structure relative to the upper bassinet frame is not limited to the aforesaid embodiment.

Figure 9:
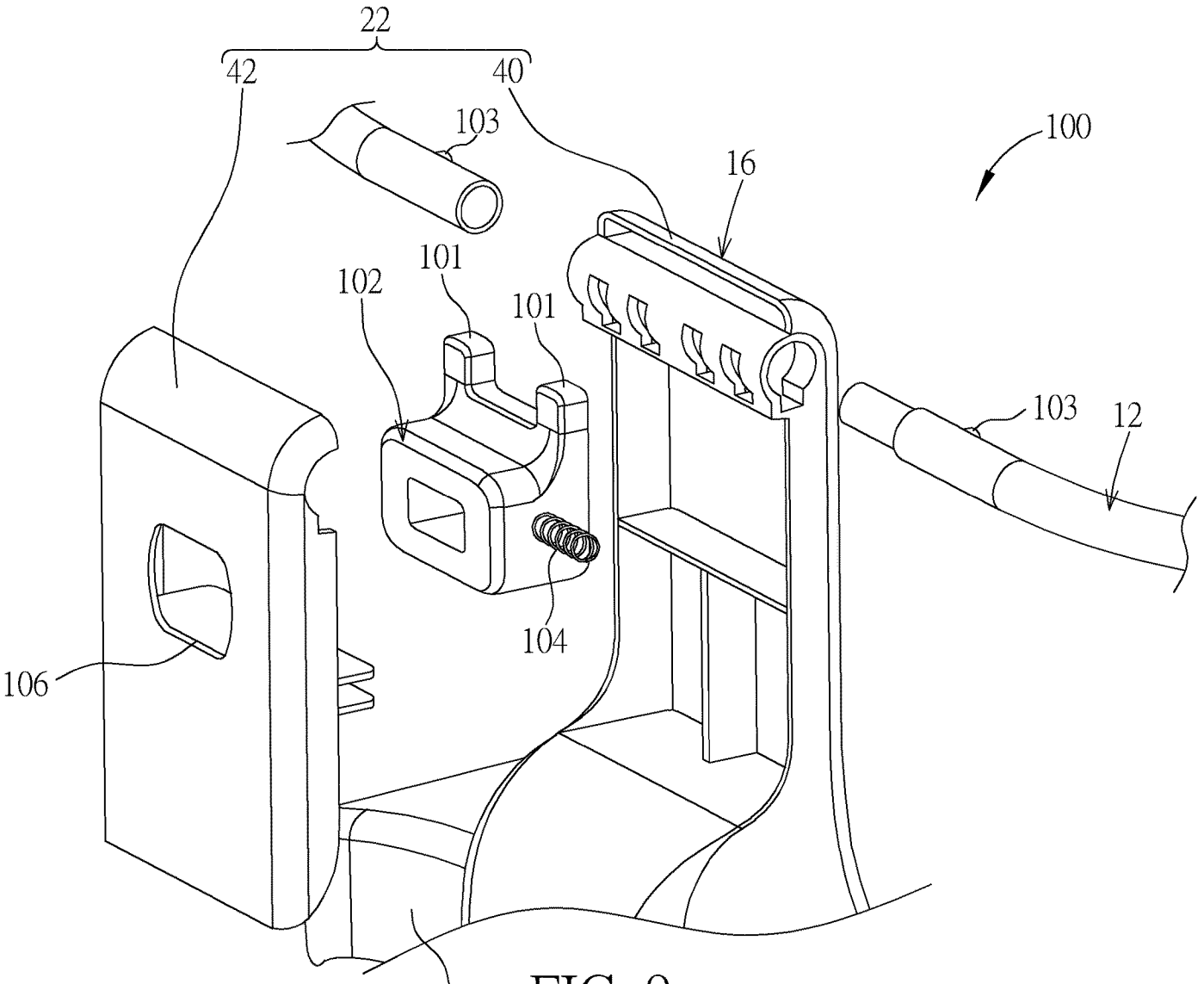
FIG. 9 is a partial exploded diagram of a foldable bassinet according to another embodiment of the present invention.
Figure 10:
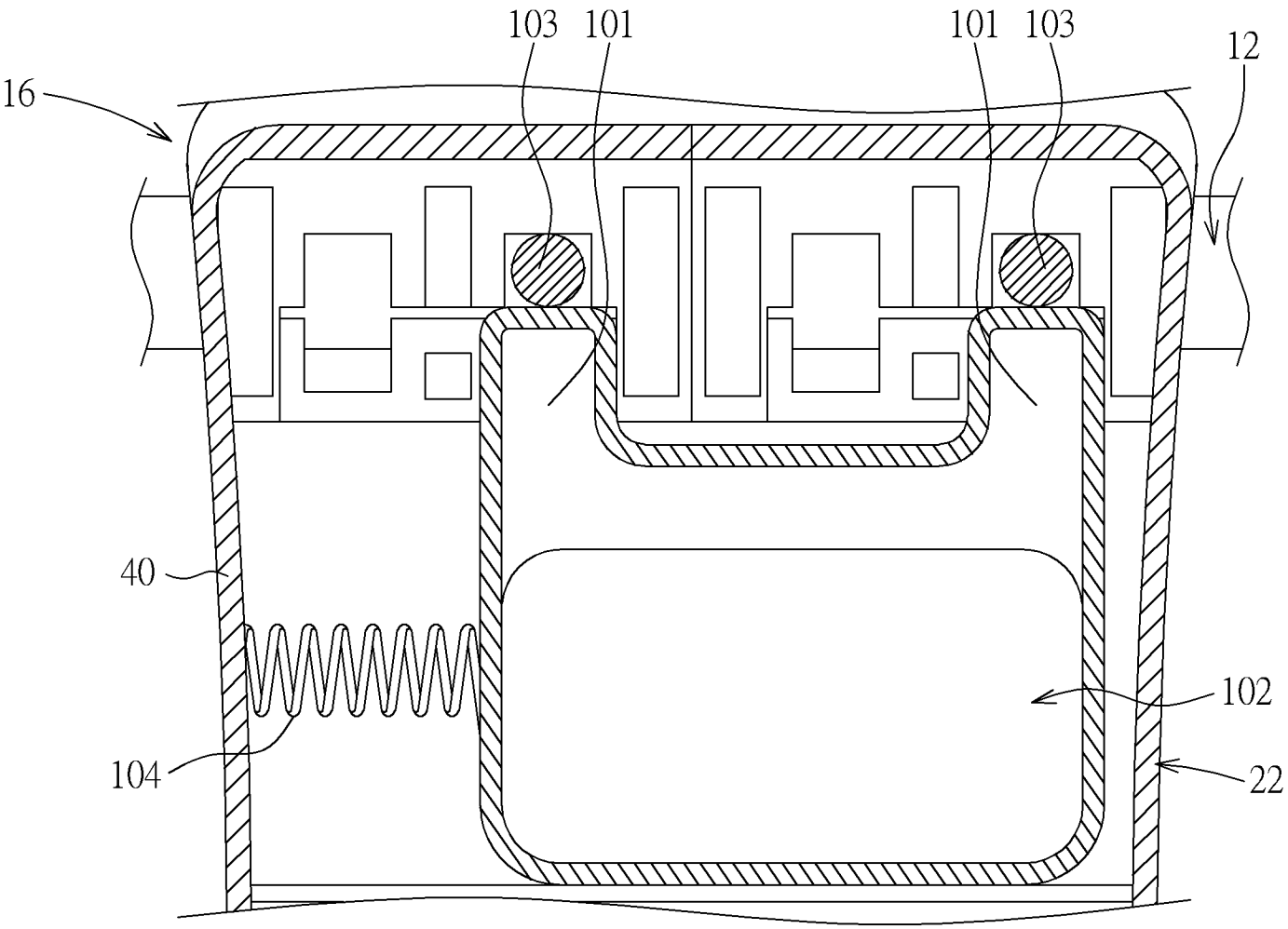
FIG. 10 is a cross-sectional diagram of a latch block being located at a locked position within an upper tower portion in FIG. 9.
Figure 11:
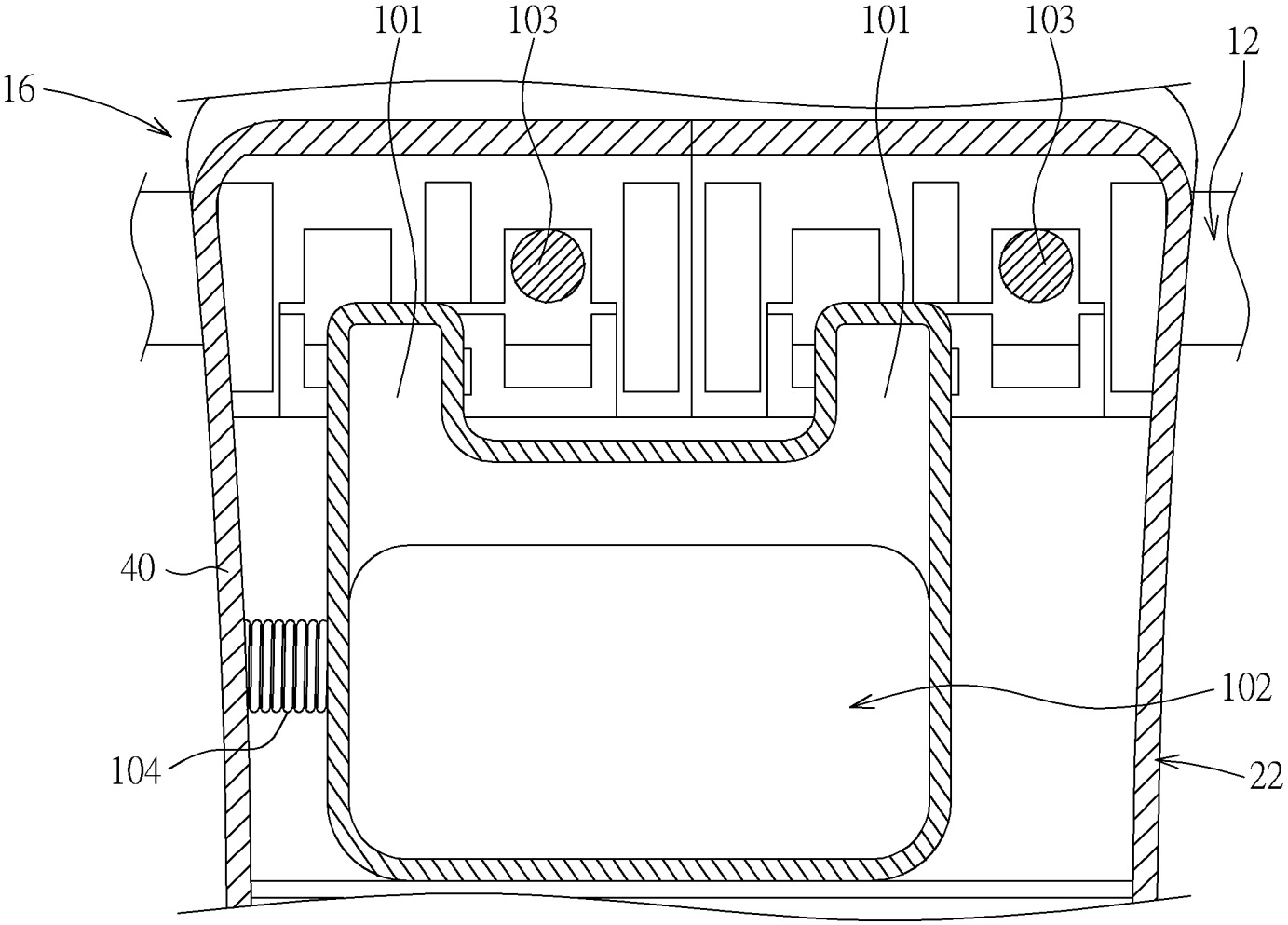
FIG. 11 is a cross-sectional diagram of the latch block in FIG. 10 sliding to an unlocked position.

For example, please refer to FIG. 9, FIG. 10, and FIG. 11. FIG. 9 is a partial exploded diagram of a foldable bassinet 100 according to another embodiment of the present invention. FIG. 10 is a cross-sectional diagram of a latch block 102 being located at a locked position within the upper tower portion 22 in FIG. 9. FIG. 11 is a cross-sectional diagram of the latch block 102 in FIG. 10 sliding to an unlocked position. Components both mentioned in this embodiment and the aforesaid embodiment represent components with similar structures or functions, and the related description is omitted herein. As shown in FIGS. 9-11, the foldable bassinet 100 includes the upper bassinet frame 12, the leg structures 16, 18, the bottom board 20, and a latch block 102 (the leg structure 18 and the bottom board 20 not shown in FIG. 9). The latch block 102 is slidably disposed within the upper tower portion 22 and has at least one protrusion 101 (two shown in FIG. 9, but not limited thereto). The upper bassinet frame 12 has a latching stud 103 corresponding to the protrusion 101. In such a manner, when the latch block 102 is located at the locked position as shown in FIG. 10 to align the protrusion 101 with the latching stud 103, the protrusion 101 abuts against the latching stud 103 for stopping rotation of the leg structure 16 relative to the upper bassinet frame 12, such that the foldable bassinet 100 can be in an expanded state steadily for use.

In practical application, the foldable bassinet 100 could further include a spring 104 connected to the latch block 102 and the upper tower portion 22 for biasing the latch block 102 to the locked position as shown in FIG. 10, so as to make locking between the leg structure 16 and the upper bassinet frame 12 more firm for safety. Furthermore, in this embodiment, an opening 106 could be formed on the cover 42 for exposing the latch block 102. Accordingly, the latch block 102 can be conveniently accessed when a caregiver's hand is engaged in the opening 106 and this provides a secure, convenient, and ergonomic means for the caregiver to unlatch engagement between the latch block 102 and the upper bassinet frame 12.

Via the aforesaid design, the foldable bassinet 100 allows that the caregiver can fold the foldable bassinet 100 for convenient storage or transport. As shown in FIGS. 10-11, when the caregiver wants to fold the foldable bassinet 100, the caregiver just needs to first raise the bottom board 20 (not shown in FIGS. 9-11, the related description could be reasoned according to the aforesaid embodiment) above the upper bassinet frame 12 and then push the latch block 102 from the to the locked position as shown in FIG. 10 to the unlocked position as shown in FIG. 11. During the aforesaid process, with sliding of the latch block 102, the protrusion 101 slides to be misaligned with the latching stud 103. Accordingly, since engagement between the protrusion 101 and the latching stud 103 is released to make the leg structure 16 rotatable relative to the upper bassinet frame 12, the caregiver can rotate the leg structure 16 and the leg structure 18 to be folded inwardly relative to the upper bassinet frame 12 for convenient storage or ease of transport. In summary, the present invention can efficiently solve the prior art problem that a typical bassinet is often large and difficult to store, so as to greatly improve the portability of the foldable bassinet.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable bassinet comprising:

an upper bassinet frame;

a pair of leg structures opposite to each other, each leg structure having an upper tower portion and a lower ledge portion, the upper bassinet frame being disposed into the upper tower portion of each leg structure to make each leg structure pivotable relative to the upper bassinet frame between a supporting position and a folding position; and a bottom board captured between and contacting the two lower ledge portions to retain each leg structure in the supporting position and to define a containing space cooperatively with the upper bassinet frame and the leg structures, the bottom board suspended by the lower ledge portions therebetween, the bottom board being detachable from the lower ledge portions;

wherein when the bottom board is detached from the two lower ledge portions, the leg structures are rotatable from the supporting position to the folding position to be folded inwardly relative to the upper bassinet frame.

2. The foldable bassinet of claim 1, wherein the foldable bassinet further comprises a bushing and a locking hub, the bushing is secured to the upper bassinet frame within the upper tower portion and has at least one protrusion formed thereon, the locking hub is concentrically located and transversely movable on the bushing to be transversely movable within the upper tower portion and comprises an engagement channel formed therein for engaging with the at least one protrusion;

wherein when the locking hub moves to a locked position, the at least one protrusion is engaged with the engagement channel for stopping rotation of the leg structure relative to the upper bassinet frame;

when the locking hub moves to an unlocked position, the at least one protrusion is disengaged from the engagement channel to make the leg structure rotatable relative to the upper bassinet frame.

3. The foldable bassinet of claim 2, wherein the foldable bassinet further comprises:

a spring configured between the locking hub and the upper tower portion for biasing the locking hub to the locked position.

4. The foldable bassinet of claim 2, wherein a buttonhole is formed on the upper tower portion, the locking hub further comprises a release button corresponding to the button hole; when the locking hub is located at the locked position, the release button passes through the button hole to be touchable on the upper tower portion; when the release button is pressed, the locking hub moves to the unlocked position.

5. The foldable bassinet of claim 2, wherein the upper tower portion comprises a supporting body and a cover, the lower ledge portion extends downward from the supporting body, the supporting body has a bearing formed under the locking hub, the cover has a riveting pin corresponding to the bearing, and the riveting pin is inserted into the bearing to lock the cover on the supporting body for containing the locking hub and the bushing.

6. The foldable bassinet of claim 5, wherein a rib extends downward from the locking hub and has an inclined-surface structure, and when the locking hub moves to the unlocked position, the bearing abuts against the inclined-surface structure to stop the locking hub from moving over the unlocked position.

7. The foldable bassinet of claim 1, wherein the foldable bassinet further comprises a latch block, the latch block is slidably disposed within the upper tower portion and has at least one protrusion, the upper bassinet frame has a latching stud corresponding to the at least one protrusion;

wherein when the latch block slides to a locked position to align the at least one protrusion with the latching stud, the at least one protrusion abuts against the latching stud for stopping rotation of the leg structure relative to the upper bassinet frame;

when the latch block slides to an unlocked position to misalign the at least one protrusion with the latching stud, the leg structure is rotatable relative to the upper bassinet frame.

8. The foldable bassinet of claim 7, wherein the upper tower portion comprises a supporting body and a cover, the lower ledge portion extends downward from the supporting body, the cover is connected to the supporting body for containing the latch block, and an opening is formed on the cover for exposing the latch block.

9. The foldable bassinet of claim 7, wherein the foldable bassinet further comprises:

a spring connected to the latch block and the upper tower portion for biasing the latch block to the locked position.

10. The foldable bassinet of claim 1, wherein the bottom board is formed of a rigid material.

11. A foldable bassinet comprising:

an upper bassinet frame;

a pair of leg structures opposite to each other, each leg structure having an upper tower portion and a lower ledge portion, the upper bassinet frame being disposed into the upper tower portion of each leg structure to make each leg structure pivotable relative to the upper bassinet frame between a supporting position and a folding position;

a bottom board captured between and contacting the two lower ledge portions to retain each leg structure in the supporting position and to define a containing space cooperatively with the upper bassinet frame and the leg structures, the bottom board being detachable from the lower ledge portions;

wherein when the bottom board is detached from the two lower ledge portions, the leg structures are rotatable from the supporting position to the folding position to be folded inwardly relative to the upper bassinet frame;

wherein the foldable bassinet further comprises a latch release slidably disposed within the upper tower portion, and an engagement latch linked to the latch release via a vertically extending link, the engagement latch being retractably disposed within a receiving area formed on a bottom of the upper tower portion, the engagement latch arranged to engage with a top rail of a playard to lock the leg structure on the playard; and, wherein when the latch release is operated, the latch release moves translationally to retract the engagement latch to release engagement between the engagement latch and the top rail to make the leg structure detachable from the playard.

12. The foldable bassinet of claim 11, wherein a carrying handle cavity is formed on the upper tower portion corresponding to the latch release for exposing the latch release, wherein the handle cavity is sized to necessitate finger actuation of the latch release.

* * * * *